US005210472A

United States Patent [19]

Casper et al.

[11] Patent Number: 5,210,472

[45] Date of Patent: May 11, 1993

[54] FLAT PANEL DISPLAY IN WHICH LOW-VOLTAGE ROW AND COLUMN ADDRESS SIGNALS CONTROL A MUCH PIXEL ACTIVATION VOLTAGE

[75] Inventors: Stephen L. Casper; Tyler A. Lowrey, both of Boise, Id.

[73] Assignee: Micron Technology, Inc., Boise, Id.

[21] Appl. No.: 864,702

[22] Filed: Apr. 7, 1992

[51] Int. Cl.[5] ..... G09G 3/10

[52] U.S. Cl. ..... 315/349; 315/169.1; 315/169.3; 315/169.4

[58] Field of Search ..... 315/349, 169.1, 169.3, 315/169.4; 313/309, 336, 351, 495

[56] References Cited

U.S. PATENT DOCUMENTS

| | | | |
|---|---|---|---|
| 4,575,765 | 3/1986 | Hirt | 315/169.3 |
| 4,866,349 | 9/1989 | Weber et al. | 315/169.4 |
| 4,908,539 | 3/1990 | Meyer | 315/169.3 |
| 5,015,912 | 5/1991 | Spindt et al. | 313/495 |
| 5,075,591 | 12/1991 | Holmberg | 313/495 |
| 5,089,292 | 2/1992 | Macaulay et al. | 313/336 X |
| 5,103,144 | 4/1992 | Dunham | 315/366 |
| 5,103,145 | 4/1992 | Doan | 315/381 |

*Primary Examiner*—Eugene R. LaRoche

*Assistant Examiner*—Son Dinh

*Attorney, Agent, or Firm*—Angus C. Fox, III

[57] ABSTRACT

A flat panel display in which low-voltage row and column address signals control a much higher pixel activation voltage. Although the invention was created with field-emission displays in mind, the technique may be used in any matrix-addressable display (e.g. vacuum fluorescent, electro-luminescent, or plasma-type displays) where high pixel activation voltages must be switched. In a preferred embodiment field emission display, emitter-to-grid voltage differential is maintained near zero during non-emission periods, and is raised to a level sufficient to cause emission by grounding pixel emitters at each row and column intersection through a pair of series-connected field-effect transistors (FETs). The emitter base electrode of each emitter node is coupled to the grid via a current-limiting transistor. Display brightness control is accomplished by varying the gate voltages of either FET, such that emission current can be adjusted. In addition, a fusible link is placed in series with the grounding path through the series-connected FETs. Gray scale shading is accompanied by varying the duty cycle of pixel actuation time as a percentage of frame time.

24 Claims, 3 Drawing Sheets

FLAT PANEL DISPLAY IN WHICH LOW-VOLTAGE ROW AND COLUMN ADDRESS SIGNALS CONTROL A MUCH PIXEL ACTIVATION VOLTAGE

FIELD OF THE INVENTION

This invention relates to flat panel displays and, more particularly, to a matrix-addressable flat panel display in which high pixel activation voltages must be switched. The invention permits row and column signal voltages compatible with conventional CMOS, NMOS, or other standard integrated circuit logic levels, in conjunction with much higher pixel activation voltages.

BACKGROUND OF THE INVENTION

For more than half a century, the cathode ray tube (CRT) has been the principal device for displaying visual information. Although CRTs have been endowed during that period with remarkable display characteristics in the areas of color, brightness, contrast and resolution, they have remained relatively bulky and power hungry. The advent of portable computers has created intense demand for displays which are lightweight, compact, and power efficient. Although liquid crystal displays are now used almost universally for laptop computers, contrast is poor in comparison to CRTs, only a limited range of viewing angles is possible, and in color versions, they consume power at rates which are incompatible with extended battery operation. In addition, color screens tend to be far more costly than CRTs of equal screen size.

As a result of the drawbacks of liquid crystal display technology, thin film field emission display technology has been receiving increasing attention by industry. Flat panel display utilizing such technology employ a matrix-addressable array of pointed, thin-film, cold field emission cathodes in combination with a phosphor-luminescent screen. Although the phenomenon of field emission was discovered in the 1950's, extensive research by many individuals, such as Charles A. Spindt of SRI International, has improved the technology to the extent that its prospects for use in the manufacture of inexpensive, low-power, high-resolution, high-contrast, full-color flat displays appear promising. However, much work remains to be done in order to successfully commercialize the technology.

There are a number of problems associated with contemporary matrix-addressable field-emission display designs. To date, such displays have been constructed such that a column signal activates a single conductive strip within the grid, while a row signal activates a conductive strip within the emitter base electrode. At the intersection of an activated column and an activated row, a grid-to-emitter voltage differential sufficient to induce field emission will exist, causing illumination of an associated phosphor on the phosphorescent screen. In FIG. 1, which is representative of such contemporary architecture, three grid (grid) strips 11A, 11B, and 11C orthogonally intersect a trio of emitter base electrode (row) strips 12A, 12B, and 12C. In this representation, each row-column intersection (the equivalent of a single pixel within the display) contains 16 field emission cathodes (also referred to herein as "emitters") 13. In reality, the number of emitter tips per pixel may vary greatly. The tip of each emitter tip is surrounded by a grid strip aperture 14. In order for field emission to occur, the voltage differential between a row conductor and a column conductor must be at least equal to a voltage which will provide acceptable field emission levels. Field emission intensity is highly dependent on several factors, the most important of which is the sharpness of the cathode emitter tip and the intensity of the electric field at the tip. Although a level of field emission suitable for the operation of flat panel displays has been achieved with emitter-to-grid voltages as low as 80 volts (and this figure is expected to decrease in the coming years due to improvements in emitter structure design and fabrication) emission voltages will probably remain far greater than 5 volts, which is the standard CMOS, NMOS, and TTL "1" level. Thus, if the field emission threshold voltage is at 80 volts, row and column lines will, most probably, be designed to switch between 0 and either +40 or −40 volts in order to provide an intersection voltage differential of 80 volts. Hence, it will be necessary to perform high-voltage switching as these row and column lines are activated. Not only is there a problem of building drivers to switch such high voltages, but there is also the problem of unnecessary power consumption because of the capacitive coupling of row and column lines. That is to say, the higher the voltage on these lines, the greater the power required to drive the display.

In addition to the problem of high-voltage switching, aperture displays suffer from low yield and low reliability due to the possibility of emitter-to-grid shorts. Such a short affects the voltage differential between the emitters and grid within the entire array, and may well render the entire array useless, either by consuming so much power that the supply is not able to maintain a voltage differential sufficient to induce field emission, or by actually generating so much heat that a portion of the array actually melts.

What is needed is a new type of field emission display architecture which overcomes the problems of high-voltage switching, which ameliorates the problem of emitter-to-grid shorts, and which reduces display power consumption.

SUMMARY OF THE INVENTION

This invention provides a technique for switching high pixel activation voltage with low signal voltages that are compatible with standard CMOS, NMOS, or other integrated circuit logic levels. Although the technique was developed to control the necessarily high grid-to-emitter voltage differentials required to induce field emission, the technique may be used in any matrix-addressable display (e.g. vacuum fluorescent, electroluminescent, or plasma-type displays) where high pixel activation voltages must be switched. However, the invention will be explained in the context of a field emission display due to the potential advantages that they possess over the other types of displays.

Instead of having row and columns tied directly to the cathode array, they are used to gate at least one pair of series-connected field effect transistors (FETs), each pair when conductive coupling the base electrode of a single emitter node to a potential that is sufficiently low, with respect to a constant potential applied to the grid, to induce field emission. Each row-column intersection (i.e. pixel) within the display may contain multiple emitter nodes in order to improve manufacturing yield and product reliability. In a preferred embodiment, the grid of the array is held at a constant potential ($V_{FE}$), which is consistent with reliable field emission when the emitters are at ground potential. Individual base electrodes may be grounded through a pair of series-connected field-effect transistors by applying a signal voltage to both the row and column lines associated with that emitter node. One of the series-connected FETs is gated by a signal on the row line; the other FET is gated by a signal on the column line. As a matter of clarification, in one particular embodiment of the invention, each pixel contains multiple emitter nodes, and each emitter node contains multiple cathode emitters. Hence, each row-column intersection controls multiple pairs of series connected FETs, and each pair controls a single emitter node containing multiple emitters.

In one embodiment, the grid is insulated from each emitter base. A pixel is turned off (i.e., placed in a non-emitting state) by turning off either or both of the series-connected FETs. From the moment that at least one of the FETs becomes non-conductive (i.e., the gate voltage, $V_{GS}$, drops below the device threshold voltage, $V_T$), electrons are discharged from the emitter tips corresponding to that pixel until the voltage differential between the base and the grid is just below emission threshold voltage.

In another embodiment of the invention, each emitter base node is coupled to the grid via a current limiting field-effect transistor, which provides a continuous low-current path, and which has a threshold voltage of $V_T$. Thus, with the base normally at a potential of $V_{GRID}-V_T$, the voltage differential between the grid and each emitter (generally less than 1 volt) is insufficient to cause field emission. However, when an emitter base is grounded through a grounding path controlled by the series-connected dual FETs at a row and column intersection, field emission occurs. In order for the grounding path to be active, both the row and column FETs must be on simultaneously (i.e., the gate voltage of each must be greater than the device threshold voltage. The use of a current-limiting transistor to couple each emitter base node to the grid provides more precise switching timing, if required.

In a preferred embodiment of the invention, for each emitter base node, the current path through the dual series-connected FETs contains a fusible link, which may be blown during testing if a base-to-emitter short exists within that emitter node, thus isolating the shorted node from the rest of the array in order to improve yield and to minimize array power consumption. Other functional nodes within that pixel continue to operate. In addition, brightness control may be accomplished by varying the gate voltages of either FET in the grounding path, which in turn, adjusts the emission current.

For all embodiments of the invention, current is regulated for each pixel through the series-connected FETs in at least one emitter electrode grounding path. This feature greatly improves brightness uniformity across the entire display. Brightness level control is easily implemented by varying the gate voltage on these FETs. In addition, low-voltage, pixel-level switching enhances the operational speed of a display. Using an architecture in which a display row line is activated and all columns are fired simultaneously, grey-scaling may implemented by varying the duty cycle of each column signal during the period of row line activation.

PREFERRED EMBODIMENT OF THE INVENTION

Figure 1:
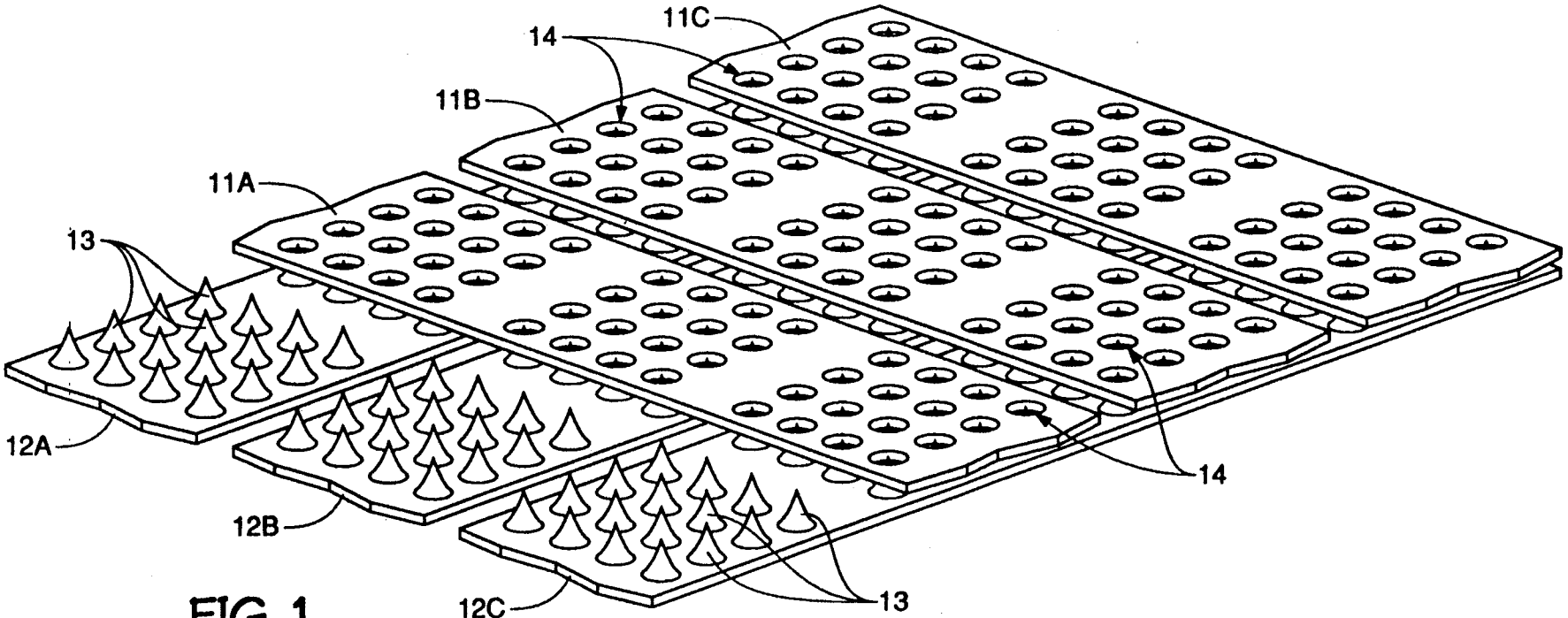
FIG. 1 (PRIOR ART)
FIG. 1 is a simplified perspective view of the grid and emitter base electrode structure in a contemporary conventional flat-panel field-emission display.
Figure 2:
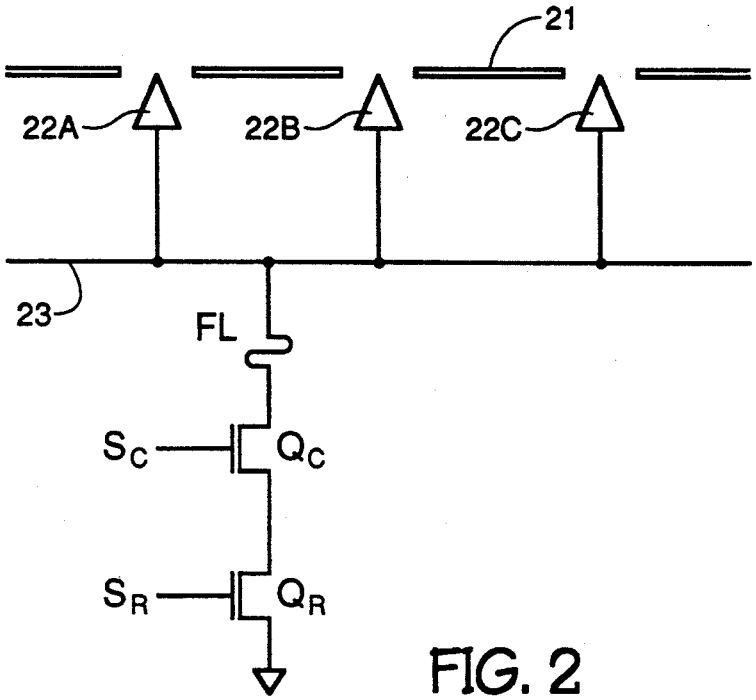
FIG. 2 is a schematic diagram of a first embodiment of a single emitter node within the new flat-panel field-emission display architecture, in which the emitter base electrode is insulated from the grid.

Referring now to FIG. 2, a single first embodiment emitter node within the new field-emission display architecture is characterized by a conductive grid (also referred to as a first pixel element) 21, which is continuous throughout the entire array, and which is maintained at a constant potential, $V_{GRID}$. Each pixel element within the array is illuminated by an emitter group. In order to enhance product reliability and manufacturing yield, each emitter group comprises multiple emitter nodes, and each node contains multiple field emission cathodes (also referred to as "field emitters" or "emitters"). Although the single emitter node depicted by FIG. 2 has only three emitters (22A, 22B, and 22C), the actual number may be much higher. Each of the emitters 22 is connected to a base electrode 23 that is common to only the emitters of a single emitter node. The combination of emitters and base electrode is also referred to herein as a second pixel element.

For the architectural embodiment depicted in FIG. 2, the base electrode 23 is insulated from the grid 21. In order to induce field emission, base electrode 23 is coupled to a pull-down node (which in the preferred embodiment, is maintained at ground potential through a pair of series-coupled field-effect transistors $Q_C$ and $Q_R$. Transistor $Q_C$ is gated by a column line signal $S_C$, while transistor $Q_R$ is gated by a row line signal $S_R$. Standard logic signal voltages for CMOS, NMOS, TTL and other integrated circuits are generally 5 volts or less, and may be used for both column and row line signals. It should be noted that transistor $Q_C$ may be replaced with two or more series connected FETs, all of which are gated by the same column line. Likewise, transistor $Q_R$ may be replaced with two or more series connected FETs, all of which are gated by the same row line. Likewise, other control-logic-gated FETs may be optionally added in series within each grounding path. A pixel is turned off (i.e., placed in a non-emitting state) by turning off either or both of the series-connected FETs ($Q_C$ and $Q_R$). From the moment that at least one of the FETs becomes non-conductive (i.e., the gate voltage $V_{GS}$ drops below the device threshold voltage $V_T$, electrons are discharged from the emitter tips corresponding to that pixel until the voltage differential between the base and the grid is just below emission threshold voltage.

Figure 3:
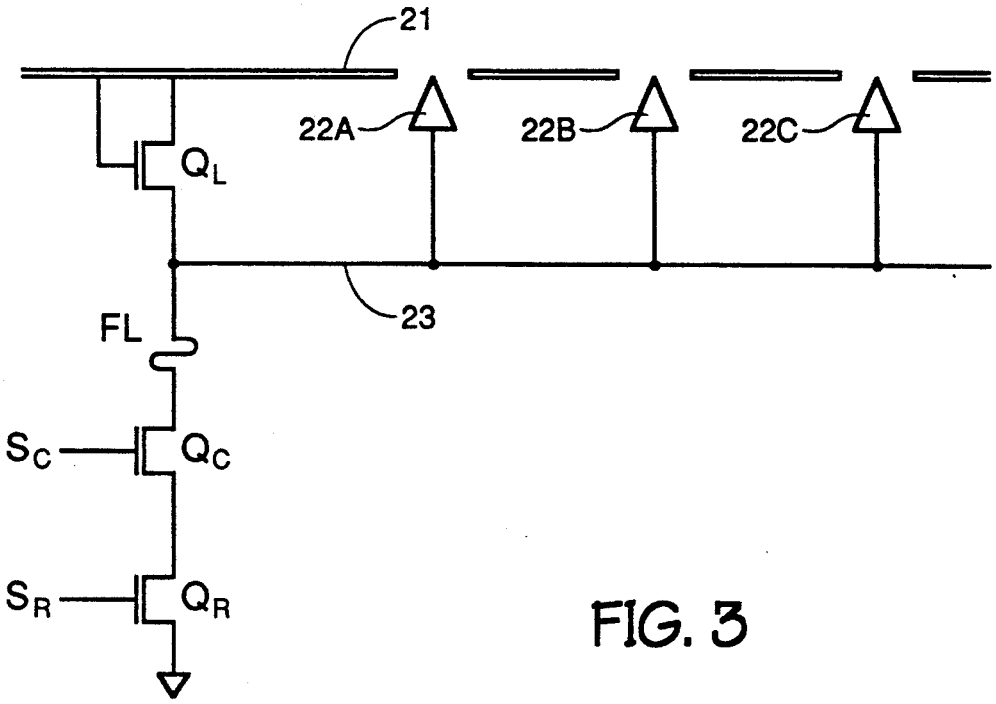
FIG. 3 is a schematic diagram of a second embodiment of a single emitter node within the new flat-panel field-emission display architecture, in which a current-limiting transistor interconnects the emitter base electrode to the grid.

Referring now to FIG. 3, a second embodiment emitter node is functionally and structurally similar to the first embodiment emitter node of FIG. 2. The primary difference is that base electrode 23 is coupled to grid 21 via a current-limiting N-channel field-effect transistor $Q_L$, which has a threshold voltage of $V_T$. Both the drain and gate of transistor $Q_L$ are directly coupled to grid 21. The channel of transistor $Q_L$ is sized such that current is limited to only that which is necessary to restore base electrode 23 and associated emitters 22A, 22B, and 22C to a potential that is substantially equal to $V_{GRID}-V_T$ at a rate sufficient to ensure adequate gray scale resolution.

Referring now to both FIGS. 2 and 3, a fusible link FL is placed in series with the pull-down current path from base electrode 23 to ground via transistors $Q_C$ and $Q_R$. Fusible link FL may be blown during testing if a base-to-emitter short exists within that emitter group, thus isolating the shorted group from the rest of the array in order to improve yield and to minimize array power consumption. It should be noted that the position of fusible link FL within the current path is inconsequential, from a circuit standpoint. That is, it accomplishes the purpose of isolating a shorted node whether it is located between transistors $Q_C$ and $Q_R$, between the base electrode 23 and the grounding transistor pair, as actually shown in FIG. 2, or between ground and the grounding transistor pair.

Still referring to FIGS. 2 and 3, gray scaling (i.e., variations in pixel illumination) in an operational display may be accomplished by varying the duty cycle (i.e. the period that the emitters within a pixel are actually emitting as a percentage of frame time. Brightness control can be accomplished by varying the emitter current by varying the gate voltages of either transistor $Q_C$ or $Q_R$ or both.

Figure 4:
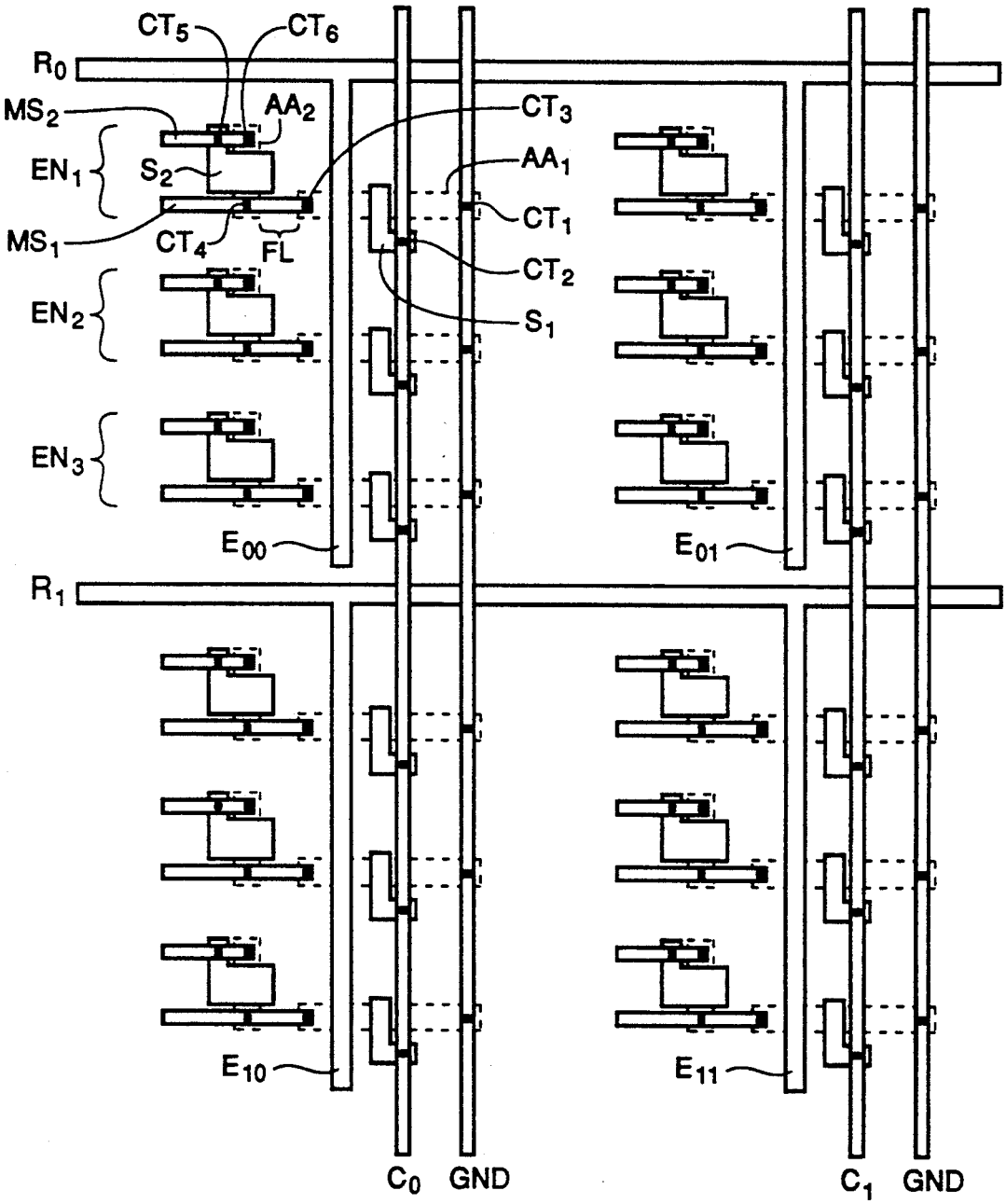
FIG. 4 is a top plan view of a preferred embodiment layout of the new flat-panel display architecture, which depicts how multiple emitter nodes may be incorporated into a single row-column intersection (i.e. single pixel).

Referring now to FIG. 4, a simplified layout is depicted, which provides for multiple emitter nodes for each row-column intersection of the display array. A pair of polysilicon row lines $R_0$ and $R_1$ orthogonally intersect metal column lines $C_0$ and $C_1$, as well as a pair of metal ground lines $GND_0$ and $GND_1$. Ground line $GND_0$ is associated with column line $C_0$, while ground line $GND_1$ is associated with column line $C_1$. For each row and column intersection (i.e., an individually-addressable pixel within the display), there is at least one rowline extension, which forms the gates and gate interconnects for multiple emitter nodes within that pixel. For example, extension $E_{00}$ is associated with the intersection of row $R_0$ and column $C_0$; extension $E_{01}$ is associated with the intersection of row $R_0$ and column $C_1$; extension $E_{10}$ is associated with the intersection of row $R_1$ and column $C_0$; and extension $E_{11}$ is associated with the intersection of row $R_1$ and column $C_1$. As all intersections function in an identical manner, only the components with the $R_0$-$C_0$ intersection region will be described in detail.

Still referring to FIG. 4, the $R_0$-$C_0$ intersection region supports three emitter nodes, $EN_1$, $EN_2$, and $EN_3$. Each emitter node comprises a first active area $AA_1$ and a second active area $AA_2$. A metal ground line GND makes contact to one end of first active area $AA_1$ at first contact $CT_1$. In combination with first active area $AA_1$, a first L-shaped polysilicon strip S1 forms the gate of field-effect transistor $Q_C$ (refer to the schematic of FIG. 2). Metal column line $C_0$ makes contact to polysilicon strip $G_1$ at second contact $CT_2$. Polysilicon extension $E_{00}$ forms the gate of field-effect transistor $Q_R$ (refer once again to FIGS. 2 and 3). A first metal strip $MS_1$ interconnects first active area $AA_1$ and second active area $AA_2$, making contact at third contact $CT_3$ and fourth contact $CT_4$, respectively. The portion of metal strip $MS_1$ between third contact $CT_3$ and fourth contact $CT_4$ forms fusible link FL. The emitter base electrode (refer to item 23 of FIGS. 2 and 3, since the emitter base electrode is not shown in this layout) is coupled to metal strip $MS_1$. A second L-shaped polysilicon strip $S_2$ forms the gate of current limiting transistor $Q_{CL}$, and second metal strip $MS_2$ is connected to second polysilicon strip $S_2$ at fifth contact $CT_5$, and to second active area $AA_2$ at sixth contact $CT_6$. The grid plate (refer to item 21 of FIGS. 2 and 3, since the grid plate is not shown in this layout) is connected to second metal strip $MS_2$. It must be emphasized that the layout of FIG. 4 is meant to be only exemplary. Other equivalent layouts are possible, and other conductive materials may be substituted for the polysilicon and metal structures.

Although only several embodiments of the invention has been disclosed in detail herein, it will be obvious to those having ordinary skill in the art that changes and modifications may be made thereto without departing from the scope and spirit of the invention as claimed. While the particular embodiment as herein depicted and described is fully capable of attaining the objectives and providing the advantages hereinbefore stated, it is to be understood that this disclosure is meant to be merely illustrative of the presently-preferred embodiment of the invention, and that no limitations are intended with regard to the details of construction or design thereof beyond the limitations imposed by the appended claims.

We claim:

1. A field emission display comprising:

multiple row address lines;

multiple column address lines;

said row address lines intersecting said column address lines, with the intersection of a single row address line with a single column address line being associated with a single pixel within said display;

a grid which is common to the entire display, and which is continuously held at a first potential;

groups of field emission cathodes, each group being associated with a particular pixel, each group being maintained at a second potential during periods of pixel inactivation through at least one current-limited, grid-to-emitter conductive path per pixel, said second potential being close enough to said first potential so as to suppress field emission, and each group being maintained at some other potential during periods of pixel activation, said other potential being sufficiently low, with respect to said first potential, to induce field emission;

means, responsive to signals on a pixel's associated row address line and column address line, for switching the potential on the group of cathodes associated with that pixel between said second potential and said other potential.

2. The field emission display of claim 1, wherein each current-limited path comprises an N-channel field-effect transistor, the drain and gate of which are coupled to the display grid, and the source of which is coupled to a single emitter base electrode.

3. The field emission display of claim 1, wherein each group of field emission cathodes contains multiple emitter nodes, each node having its own emitter base electrode on which is located multiple field emission cathodes, said emitter base electrode being common to no other emitter node.

4. A field emission display comprising:

multiple row address lines;

multiple column address lines;

said row address lines intersecting said column address lines, with the intersection of a single row address line with a single column address line being associated with a single pixel within said display;

a grid which is common to the entire display, and which is continuously held at a first potential;

groups of field emission cathodes, each group being associated with a particular pixel, each group being maintained at a second potential during periods of pixel inactivation, said second potential being close enough to said first potential so as to suppress field emission, and each group being maintained at some other potential during periods of pixel activation, said other potential being sufficiently low, with respect to said first potential, to induce field emission;

at least one pull-down current path between the cathode group of each pixel and said other potential, said path being activatable in response to signals on a pixel's respective row address line and column address line, so as to enable switching of the potential applied to the cathode group associated with that pixel between said second potential and said other potential.

5. The field emission display of claim 4 wherein each emitter base electrode has its own pull-down current path, and each pull-down current path contains a fusible link, which may be blown during testing so that emitter nodes which have one or more emitter-to-grid shorts may be functionally isolated from the display.

6. The field emission display of claim 4, wherein each pull-down current path comprises multiple series-connected field-effect transistors, at least one of which is gated by a signal on the associated row address line, with at least one of the remainder being gated by a signal on the associated column address line.

7. The field emission display of claim 6, wherein voltage levels utilized for said row signal and said column signal are compatible with standard logic signal voltages.

8. Field emission display of claim 6, wherein variations in pixel brightness are accomplished by varying the gate voltages on at least one of the FETs comprising each of the pull-down current paths associated with a particular pixel, such that emission current within emitters of that pixel is varied.

9. The field emission display of claim 4, wherein said other potential is between ground potential and said second potential.

10. A flat panel display comprising:

multiple row address lines;

multiple column address lines;

said row address lines intersecting said column address lines, with the intersection of a single row address line with a single column address line being associated with a single pixel within said display;

first and second elements for each pixel, said pixel producing emitted light when a voltage differential is applied between the two elements (hereinafter, the inter-element voltage differential) which exceeds a pixel activation threshold;

a pull-down node, which is maintained at a constant potential;

at least one selectively activatable pull-down current path between said second pixel element and said pull-down node, said path coupling said node to said second pixel element when said path is activated, providing an inter-element voltage differential that exceeds the pixel activation threshold, and said path decoupling said node from said second pixel element when said path is inactivated, providing an inter-element voltage differential that does not exceed the pixel activation threshold.

11. The flat panel display of claim 10, wherein said pull-down node is maintained at ground potential.

12. The flat panel display of claim 10, wherein each pull-down path comprises multiple series-coupled field-effect transistors, at least one of which is gated by a signal on the pixel's associated row address line, with at least one of the remainder being gated by a signal on the pixel's associated column address line.

13. The flat panel display of claim 12, wherein each second pixel element is charged to approximately the voltage level of its associated first pixel element during periods of pixel inactivation through at least one current-limited conductive path per pixel.

14. In a row and column addressable flat panel display having multiple row address lines which intersect multiple column address lines, the intersection of a single row address line and single column address line being associated with a single pixel within the display, and each pixel having a pixel activation voltage, a method for controlling the pixel activation voltage by means of a first signal voltage selectively applied to individual row address lines and a second signal voltage selectively applied to individual column address lines, said first and second signal voltages being less than half said pixel activation voltage.

15. In a field emission display having multiple row address lines which intersect multiple column address lines, the intersection of a single row address line and a single column address line being associated with a single pixel within the display, a grid which is common to the entire display, the groups of field emission cathodes, each group being associated with a particular pixel, a method for selectively activating individual pixels within the display, said method comprising the following steps:

maintaining, during periods when a particular pixel is inactive, a first voltage differential between the grid and the group of cathodes associated with that pixel, said first voltage differential being insufficient to cause field emission;

raising, during periods when that pixel is active, the voltage differential between the grid and the group of cathodes associated with that pixel, to a second voltage differential, said second voltage differential being sufficient to cause field emission, said raising of the voltage differential being accomplished by pulling down the potential on the group of cathodes associated with that pixel through at least one pull-down current path gated by a row signal and a column signal associated with that pixel.

16. The method of claim 15, wherein the potential on the group of cathodes associated with an activated pixel is pulled down to ground potential.

17. The method of claim 15, wherein each pull-down current path comprises multiple series-coupled field-effect transistors, at least one of which is gated by a row signal, and the remainder of which are gated by a column signal.

18. The method of claim 17, wherein voltage levels utilized for said row signal and column signal are compatible with standard logic signal voltages.

19. The method of claim 15, wherein each group of cathodes is charged to a near-grid voltage level during periods of pixel inactivation through at least one current-limited conductive path from the grid to each group of cathodes.

20. The method of claim 19, wherein each current-limited path comprises an N-channel field-effect transistor, the drain and gate of which are coupled to the display grid, and the source of which is coupled to an emitter base electrode.

21. The method of claim 15, wherein each cathode group associated with a single pixel contains multiple emitter nodes, each node having its own emitter base electrode on which are located multiple field emission cathodes.

22. The method of claim 21, wherein each emitter base electrode has a pull-down current path, and each pull-down current path contains a fusible link, which may be blown during testing so that emitter nodes which have one or more emitter-to-grid shorts may be functionally isolated from the display.

23. The method of claim 22, wherein each pixel has multiple fuse-isolable emitter groups.

24. The method of claim 17, wherein variations in pixel brightness are accomplished by varying the gate voltages on at least one of the FETs comprising each of the pull-down current paths associated with a particular pixel, such that emission current for emitters associated with that pixel is varied.

* * * * *